US010876543B2

(12) United States Patent
Zoppas et al.

(10) Patent No.: US 10,876,543 B2
(45) Date of Patent: Dec. 29, 2020

(54) COVER FOR CENTRIFUGAL PUMP

(71) Applicant: I.R.C.A. S.P.A. Industria Resistenze Corazzate E Affini, San Vendemiano (IT)

(72) Inventors: Federico Zoppas, Treviso (IT); Maurizio Biasi, Fontanelle (IT); Damiano Montagner, Codogne (IT); Stefano Zanella, Montebelluna (IT)

(73) Assignee: I.R.C.A. S.P.A. INDUSTRIA RESISTENZE CORAZZATE E AFFINI, San Vendemiano (IT)

( * ) Notice: Subject to any disclaimer, the term of this patent is extended or adjusted under 35 U.S.C. 154(b) by 158 days.

(21) Appl. No.: 16/082,675

(22) PCT Filed: Mar. 13, 2017

(86) PCT No.: PCT/IB2017/051445

§ 371 (c)(1),
(2) Date: Sep. 6, 2018

(87) PCT Pub. No.: WO2017/153972

PCT Pub. Date: Sep. 14, 2017

(65) Prior Publication Data

US 2019/0063456 A1 Feb. 28, 2019

(30) Foreign Application Priority Data

Mar. 11, 2016 (IT) ..... 102016000025697

(51) Int. Cl.
*F04D 29/42* (2006.01)
*A47L 15/42* (2006.01)
(Continued)

(52) U.S. Cl.
CPC ..... *F04D 29/4293* (2013.01); *A47L 15/4225* (2013.01); *A47L 15/4285* (2013.01);
(Continued)

(58) Field of Classification Search
CPC ..... A47L 15/4225; A47L 15/4285; F04D 15/0077; F04D 15/0088; F04D 29/426;
(Continued)

(56) References Cited

U.S. PATENT DOCUMENTS 7,965,928 B2 * 6/2011 Eichholz ..... D06F 39/04 392/417
8,094,998 B2 * 1/2012 Rijskamp ..... F24H 9/1818 392/448
(Continued)

FOREIGN PATENT DOCUMENTS

CN 202195572 4/2012
CN 202195572 U * 4/2012
WO 2016028049 2/2016

*Primary Examiner* — Patrick Hamo
*Assistant Examiner* — Joseph S. Herrmann
(74) *Attorney, Agent, or Firm* — Stetina Brunda Garred & Brucker

(57) ABSTRACT

A cover (1) for centrifugal pump comprising a heating element (8) which has a heating stretch (10) and two end stretches (12) connected to the heating stretch (10), in which the heating element (8) crosses the cover (1) so that the heating stretch (10) is below the cover (1) and the two end stretches (12) are above the cover (1), and wherein at least one first portion (14) of the heating stretch (10) is in contact with the cover (1), and wherein at least one second portion (16) of the heating stretch (10) is spaced apart from the inner face (4).

19 Claims, 4 Drawing Sheets

(51) Int. Cl.

| | |
|---|---|
| ***F04D 29/58*** | (2006.01) |
| ***F04D 15/00*** | (2006.01) |
| *H05B 3/82* | (2006.01) |
| *H05B 3/46* | (2006.01) |
| *H05B 1/02* | (2006.01) |

(52) U.S. Cl.
CPC ..... *F04D 15/0077* (2013.01); *F04D 15/0088* (2013.01); *F04D 29/426* (2013.01); *F04D 29/586* (2013.01); *F05B 2260/20* (2013.01); *H05B 1/0252* (2013.01); *H05B 3/46* (2013.01); *H05B 3/82* (2013.01)

(58) Field of Classification Search
CPC ..... F04D 29/4293; F04D 29/586; F05B 2240/14; F05B 2260/20; H05B 1/0252; H05B 3/46; H05B 3/82
See application file for complete search history.

(56) References Cited

U.S. PATENT DOCUMENTS

| | | | | |
|---|---|---|---|---|
| 10,334,665 | B2 * | 6/2019 | Kim | H05B 3/04 |
| 2004/0173249 | A1 | 9/2004 | Assmann et al. | |
| 2015/0000713 | A1 * | 1/2015 | Vallejo Noriega | A47L 15/4206 134/108 |
| 2015/0157185 | A1 * | 6/2015 | Welch | A47L 15/4285 134/25.2 |
| 2016/0040686 | A1 * | 2/2016 | Li | F04D 1/00 415/177 |
| 2016/0109152 | A1 * | 4/2016 | Teufl | F24H 1/101 392/318 |

* cited by examiner

COVER FOR CENTRIFUGAL PUMP

CROSS REFERENCE TO RELATED APPLICATION(S)

The present application claims priority to PCT International Application No. PCT/IB2017/051445 filed on Mar. 13, 2017, which application claims priority to Italian Patent Application Nos. 102106000025697 filed Mar. 11, 2016, the entirety of the disclosures of which are expressly incorporated herein by reference.

STATEMENT RE: FEDERALLY SPONSORED RESEARCH/DEVELOPMENT

Not Applicable.

FIELD OF THE INVENTION

The present invention is related to a heater for household appliances, in particular a cover provided with heating element which can be used for a centrifugal pump.

BACKGROUND ART

In many applications for household appliances, a heater is used to bring a fluid—typically water—to the operating temperature required.

Generally, the heaters are coupled to the recirculation pumps of the household appliances, for example to centrifugal pumps for dishwashers.

One type of heaters provides a metal cover to which there is coupled a resistor which generates the heat required to heat the water. The metal cover closes a chamber in which the water flows and the resistor is in contact with the outer face of the cover. The latter is not in contact with the water. When the resistor heats up, accordingly also the cover heats up, which transmits the heat to the water in contact with the inner face thereof. Therefore, in this type of heaters, the resistor is not in direct contact with the water to be heated because the cover is interposed between resistor and water.

Generally, the metal cover is provided with a control device and with a safety device for managing anomalous or undesired operating conditions. For example, a thermostat and a thermal fuse may be coupled to the cover. The thermostat is used to manage the temperature of the water while the thermal fuse serves to manage anomalous operating conditions of the resistor.

Although it is quite common, this type of heater has limits.

SUMMARY OF THE INVENTION

It is one object of the present invention to provide a cover for a pump of a household appliance, e.g. a dishwasher, which is energetically more efficient with respect to the prior art.

It is another object of the present invention to provide a cover which is reliable and easy to make at competitive costs.

The invention achieves this and other objects which will be apparent in light of the present description, by means of a cover for a centrifugal pump for liquid of a household appliance which comprises a wall having an inner face destined to come into contact with the liquid and with an outer face, opposite to the inner face, an electric resistor, or electric heater, for heating the liquid, fixed to the cover and having one heating stretch and two end stretches connected to the heating stretch, wherein the electric resistor crosses the cover so that the heating stretch extends from the side of the inner face and the two end stretches project from the side of the outer face, whereby the heating stretch is adapted to be in contact with the liquid, wherein at least one first portion of the heating stretch is in contact with the inner face, and wherein at least one second portion of the heating stretch is spaced apart from the inner face.

According to the invention, the heating stretch of the resistor can therefore be directly in contact with the liquid. Moreover, advantageously according to the invention, at least a portion, e.g. one portion only, of heating stretch is in contact with the inner face of the cover, and at least one second portion, e.g. one second portion only, is spaced apart from the inner face of the cover, i.e. the at least one second portion is not in contact with the inner face of the cover.

Thereby, the heating of the fluid is optimized with respect to the prior art. Advantageously, not only does the invention allow an optimal heat exchange between the electric resistor and the water to be heated, but it also allows an increased sensitivity of a safety device and/or of a control device when they are coupled to the cover.

More specifically, the heat exchange between the heating stretch and fluid is optimized because, given that at least one portion of heating stretch is provided spaced apart from the cover, substantially all the surface of such spaced apart portion can be lapped by the fluid and therefore can exchange heat with the fluid. At the same time, given that at least one portion is provided in contact with the cover, a safety device, e.g. a thermal fuse, may be fixed on the cover at such portion in contact, so that such device is particularly sensitive to the temperature of the heating stretch.

Advantageously, the invention allows to obtain optimal reliability of the resistor and a low accumulation of limestone.

In particular, the solution of the invention allows avoiding the dirt and/or the limestone to be block between resistor and wall of the cover, and therefore generally allows a very reliable resistor to be obtained.

Moreover, a control device, e.g. a thermostat, can be assembled on the cover at the portion of heating stretch spaced apart from the cover, whereby the thermostat is particularly sensitive to the temperature of the fluid.

Further advantages of the invention are:

- accurately controlling the temperature of the water without affecting the temperature of the resistor, despite the extreme compactness of the heater, in particular in light of the fact that the thin layer of fluid, e.g. water, present between resistor and thermostat is sufficient to control the temperature of the fluid;
- using less performing and therefore more affordable thermostats, in particular for the anti-boiling function;
- assembling other types of sensors, for example of the NTC type, in order to control the temperature of the water.

Preferably, the cover of the invention comprises one electric heater only, in particular one sheathed electric resistor only. One or more resistive wires are provided inside the sheathed electric resistor.

Preferably, the heating stretch, or active stretch, defines a curvilinear axis and is completely comprised between two connection stretches which join the heating stretch with end stretches. The connection stretches define a respective axis, preferably curvilinear, which is transverse to the axis defined by the heating stretch. The end stretches also define a respective axis, preferably rectilinear, which is transverse to the axis defined by the heating stretch.

According to one aspect, is also provided a centrifugal pump or recirculation pump, in particular for household appliances, comprising a body and the cover of the invention, wherein the cover is restrained to the body.

The dependent claims describe preferred embodiments of the invention.

BRIEF DESCRIPTION OF THE DRAWINGS

Further features and advantages of the invention will be more apparent in light of the detailed description of preferred, but not exclusive, embodiments of a cover for centrifugal pump according to the invention, illustrated by way of a non-limiting example, with the aid of the accompanying drawings, in which.

The same references in the drawings identify the same elements or components.

DETAILED DESCRIPTION OF EMBODIMENTS OF THE INVENTION

Figure 7:
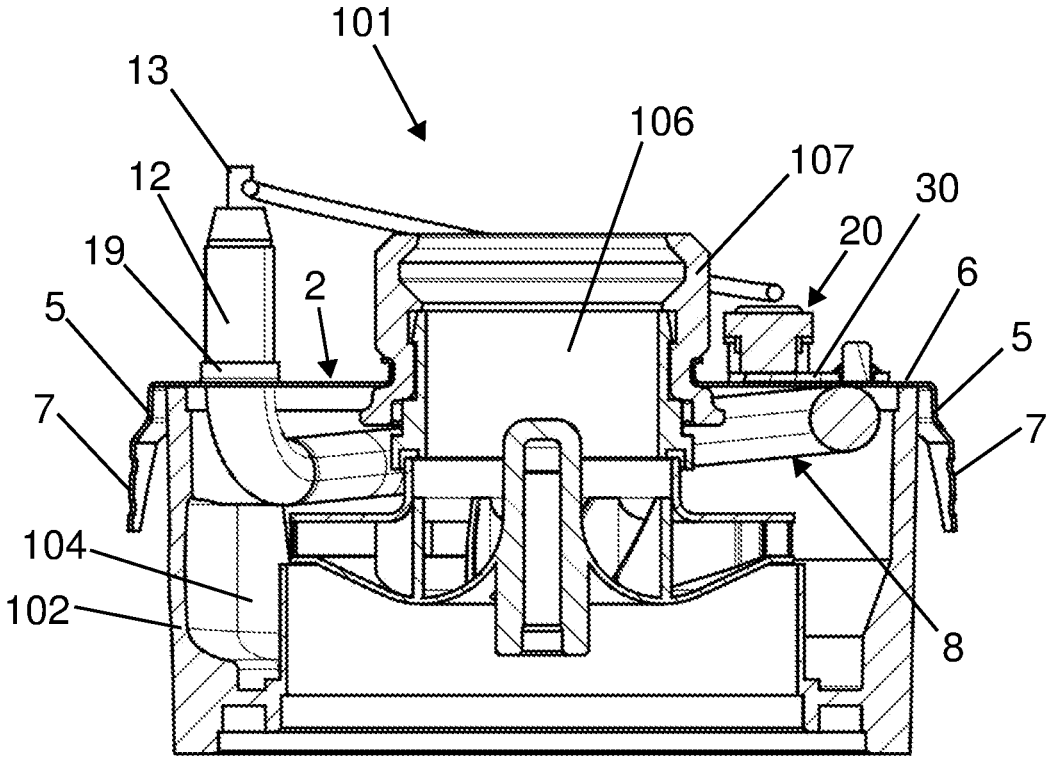
FIG. 7 shows a pump according to the invention.

With reference to the figures, there is described a cover 1 for a pump 101 (FIG. 7), in particular for a centrifugal pump or a recirculation pump. Indeed, cover 1 is configured to be fixed to a body 102 of pump 101, for example a body which laterally delimits a pumping chamber 104 of a liquid. Once it is fixed to the body 102, cover 1 also delimits the pumping chamber 104, thus acting as closing element. In particular, it is a cover of a pump used in household appliances, such as for example a dishwasher or a washing machine. Typically, this type of pump operates with water.

In this embodiment, cover 1 is generally circular in shape.

Cover 1 comprises a wall 2 which has an inner face 4, or lower face 4, and an outer face 6, or upper face 6.

The lower face 4 is intended to come into contact with the liquid when cover 1 is fixed to body 102 of pump 101. In other words, the lower face 4 is an inner face of pump 101.

The upper face 6 is opposite to the lower face 4, and is a face external to pump 101, i.e. it is not intended to come into contact with the liquid.

At the center of cover 1, there is provided a circular opening 3 crossed by a conduit 106 of pump 101, for example an inlet conduit of the liquid, when cover 1 is fixed to body 102. The upper face 6 comprises a shoulder 9 which extends outwards at the circular contour of opening 3. Conduit 106 is fluid-tight fixed to shoulder 9, for example by means of one or more connection elements 107 (see FIG. 7).

A skirt 5 extends downwards from the contour of wall 2. A plurality of tabs 7, which in this embodiment are four, extends downwards from skirt 5, the tabs being radially spaced apart from one another. The tabs 7 serve to fix cover 1 to the body 102, or to another element, of pump 101. Cover 1 comprises a heating element which typically is a tubular electric resistor, in particular a sheathed resistor 8. Sheathed resistors are well known to technicians in the field and typically comprise a metal casing, e.g. made of stainless steel. Preferably, but not exclusively, the outer surface of the casing, which is the outermost part of the shielded resistor 8, has a circular section. The electric resistor 8, or simply resistor 8, comprises a heating stretch 10 and two end stretches 12 connected to the heating stretch 10. Each end stretch 12 is connected to the heating stretch 10 by means of a union stretch 11, or connection stretch 11, preferably having curvilinear axis. In other words, the heating stretch 10 extends between the two end stretches 12, in particular between the two union stretches 11.

Each end stretch 12 comprises a pin 13. As is described below, pin 13 of a first end stretch 12 is electrically connected to a safety device 20, and pin 13 of a second end stretch 12 is electrically connected to a control device 22.

Resistor 8 serves to heat the liquid which circulates in pump 101. Indeed, when current is caused to circulate in resistor 8, the heating stretch 10 heats up. Generally, the end stretches 12 are at a lower temperature with respect to the heating stretch 10. Typically, the heating stretch 10 is also called "active" stretch. Typically, at least one resistive wire (not illustrated) which generates heat is provided inside the sheathed resistor 8. Preferably, but not necessarily, the heating of the liquid occurs solely by means of resistor 8.

Resistor 8 crosses the cover 1, in particular the wall 2, and is fixed thereto.

More in details, the arrangement of resistor 8 with respect to wall 2 is such that the end stretches 12 are arranged on one side of wall 2, and in particular project from the upper side, or outer side, which is the side that comprises the upper face 6. Instead, the heating stretch 10 and the connection stretches 11 are arranged on the side opposite to wall 2, and in particular are arranged on the lower side, or inner side, which is a side that comprises the lower face 4. In other words, the end stretches 12 are above wall 2 and the heating stretch 10 and the connection stretches 11 are below wall 2. To ensure that resistor 8 passes through the cover 1, wall 2 is provided with two holes 18 crossed by a respective end stretch 12. More in details, the end stretches 12 are fluid-tight sealed to the inner edge of the respective hole 18. Fixing preferably is made by means of welding or brazing. In this embodiment, a shoulder 19 extends outwards from the circular contour of each hole 18 to facilitate such fixing. The holes 18 are plugged due to the effect of the fluid-tight fixing. This solution ensures that the liquid does not unwantingly leak out of the pumping chamber 104.

In a possible embodiment, resistor 8 has at least one first portion 14 in contact with the lower face 4 and at least one second portion 16 spaced apart from, i.e. not in contact with the lower face 4. In particular, portion 16 facing the inner face 4 is spaced apart from the latter. In this embodiment, portion 14 of heating stretch 10 which is in contact with the lower face 4, is substantially the portion which is at the greater distance from the end stretches 12.

In this embodiment, there is provided only one portion 14 in contact with the lower face 4 and only one portion 16 spaced apart from the lower face 4. However, without departing from the present invention, a plurality of portions can be provided in contact with the lower face, e.g. two or three or several portions in contact. Accordingly, several portions spaced apart from the lower face can be provided, preferably alternated with the portions in contact.

Portion 14 preferably is fixed to the lower face 4 by means of welding or brazing, in this latter case using a suitable heat conducting material. Thereby, advantageously even if wall 2 is subjected to thermal expansions, the resistor remains firmly fixed thereto. Alternatively, although one or more portions are in contact with the lower face, the fixing of the resistor to the cover may be achieved only by fixing the end stretches to the holes. In this case, the suitable geometry of the heating stretch with respect to the end stretches can easily be determined.

The heating stretch 10 defines an axis X, which preferably is substantially curvilinear. Preferably, portion 14 has a length along axis X ranging between 1% and 50% of the total length of the heating stretch 10 along axis X, the remaining part of length being the length of portion 16.

For example, portion 14 has a length along axis X ranging between 10% and 40%, or between 10% and 20%, of the total length of the heating stretch 10 along axis X, the remaining part of length being the length of portion 16.

It is preferable that portion 16 has a length along axis X which is greater than the length of portion 14 along axis X.

Preferably, but not exclusively, the length of portion 14 is at least equal to 1 mm, preferably it ranges between 1 mm and 314 mm, or between 10 mm and 100 mm, or between 20 and 40 mm. For example, when the heating stretch 10 has a length of about 200 mm, portion 14 has a length ranging between 20 and 40 mm.

Preferably, the heating stretch 10 has a length ranging between 90 and 314 mm, for example equal to about 200 mm. Portion 14 preferably has a shorter length with respect to the length of the heating stretch. Alternatively, the whole heating stretch is in contact with the lower face.

Figure 5:
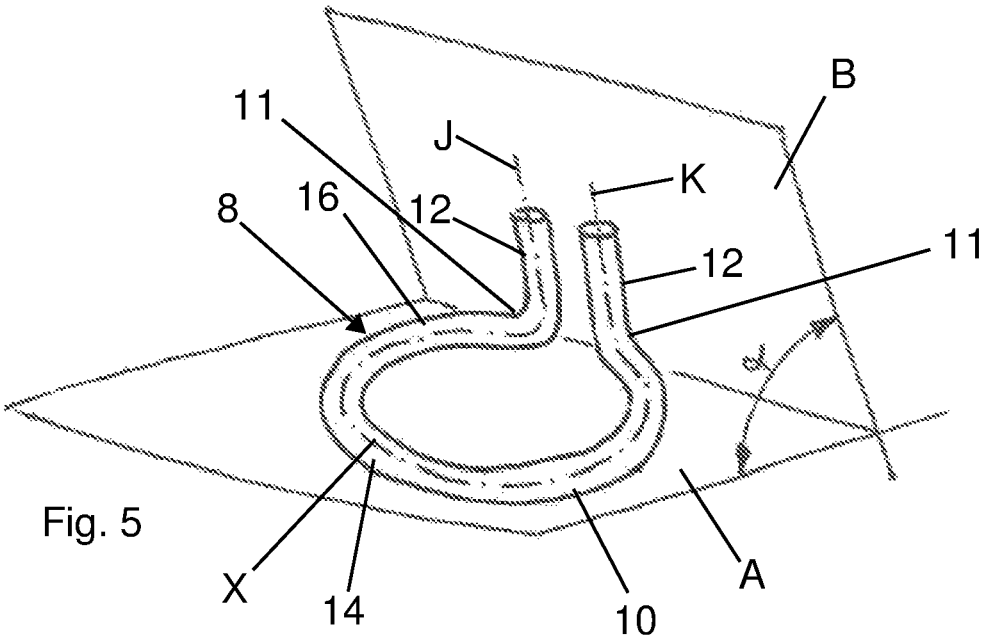
FIG. 5 shows a diagrammatic view of a component of the cover of the invention.

Preferably, the heating stretch 10 defines a curvilinear axis X (FIG. 5) which lies in a plane A. In particular, the heating stretch 10, or active stretch, substantially defines an arc of circumference. The end stretches 12 define a respective axis J, K. The two axes J, K, preferably rectilinear, substantially lie on a same plane B. The connection stretches 11 are curved and transverse to the curvilinear axis X. More specifically, the connection stretches 11 are transverse to the curvilinear axis X and to plane A. Preferably, the connection stretches 11 define a respective curvilinear axis which, at a first end thereof, coincides with axis J, K of the corresponding end stretch 12; while it coincides at a second end thereof, with the curvilinear axis X of the heating stretch 10.

Preferably, but not exclusively, the connection stretches 11 are not an active stretch.

Therefore, the heating stretch 10, or active stretch, is arranged between the connection stretches 11.

Preferably, but not exclusively, plane A and plane B mutually form an angle $\alpha$ which is smaller than 90°, for example ranging between 30° and 90°, or for example ranging between 70° and 85°.

In the above-described embodiment, the axes J and K are substantially parallel to each other, although they alternatively may be skew.

According to an optional configuration, which holds true for all embodiments, a minimum distance is provided between portion 16 and the inner face 4 of the cover. There is an empty space between portion 16 and the inner face 4. Preferably, said minimum distance is equal to at least 0.5 mm, e.g. at least 1 mm. In particular, to obtain such a minimum distance, the space between heating stretch 10 and inner face 4 in which the distance is less than said minimum distance, can be filled with filler material, such as for example the filler material used to braze resistor 8 to the inner face 4. Portion 14 is therefore defined by the whole part of the heating stretch 10 in contact with the inner face 4 by means of the filler material.

Moreover, it is preferable that the maximum distance between portion 16 and the inner face 4 of the cover, in particular between the part of portion 16 facing the inner face 4, ranges between 20 and 40 mm.

Cover 1 is optimally configured to be coupled to one or more safety devices and/or to one or more control devices. In particular, it is preferable that the safety device(s) are of the non-resettable type, or non-rechargeable type, which are also known as "one shot" devices. Typically, but not exclusively, a safety device of this type causes an opening of the electrical circuit, for example of the supply circuit, by means of a fuse or by means of a bimetallic element.

A safety device is preferably a thermal fuse 20.

It is also preferable that the control device(s) are of the resettable, or "self-resetting", type. A control device is preferably a thermostat 22, in particular of the self-resetting type.

In this embodiment, there are provided one thermal fuse 20 only and one thermostat 22 only.

The thermal fuse 20 is fixed to the upper face 6, and in particular is in contact, or in any case in thermal contact, therewith. The thermal fuse 20 is fixed in a first area of the upper face 6 close to, or substantially at the area of the lower face 4 in contact with portion 14 of the heating stretch. In particular, when the thermal fuse 20 is close to the area of the upper face 6 close to the area of the lower face 4 in contact with portion 14, preferably it is within a distance equal to about 25 mm from such an area of the lower face 4. For example, considering the area of the upper face 6 above portion 14 as the center, the thermal fuse is arranged within a radius of 25 mm.

The thermal fuse 20 is electrically connected to resistor 8, for example by means of an electrical connector 21 connected to an end stretch 12, in particular to a pin 13. Moreover, the thermal fuse 20, or safety device, is configured to be connected to an electrical supply source (not illustrated). In this embodiment, the thermal fuse is provided with a tab 25 adapted to be electrically connected to the supply source, for example by means of a connector (not illustrated).

Advantageously, the thermal fuse 20 is in thermal contact with resistor 8. In particular, considering the arrangement thereof, the thermal fuse 20 is very sensitive to the variations in temperature of resistor 8 and can promptly intervene in case of anomalous or undesired operating conditions. For example, the thermal fuse 20 can intervene in dry operating conditions, i.e. without fluid in circulation, which cause an undesired and excessive increase in the temperature of the resistor. The thermal fuse 20 intervenes by interrupting the supply to resistor 8 when the latter reaches a preset temperature. It is worth noting that resistor 8 can also incorporate another thermal fuse (not illustrated) therein. In this case, there can be a dual control.

Thermostat 22 is also fixed and in contact with the upper face 6. In particular, thermostat 22 is arranged in a second area of the upper face 6 below which the lower face 4 can come directly into contact with the liquid. In other words, it is a different area from the one where the thermal fuse 20 is positioned. Thereby, thermostat 22 is very sensitive to the variations in temperature of the liquid and can manage the temperature of resistor 8 according to the temperature of the liquid. The positioning of thermostat 22 allows a very accurate adjustment of the temperature of the liquid without being affected by the temperature of resistor 8.

Also thermostat 22 is electrically connected to resistor 8, for example by means of an electrical connector 23 connected to an end stretch 12, in particular to a pin 13, which is different from the one to which the thermal fuse 20 is connected. Moreover, thermostat 22, or the control device, is configured to be connected to the electrical supply source. In this embodiment, thermostat 22 is provided with a tab 27 adapted to be electrically connected to the supply source, for example by means of a connector (not illustrated).

Thermostat 22 can thus have a control on the temperature of the liquid by operating on resistor 8, for example on the electrical supply supplied to the resistor.

Figure 4:
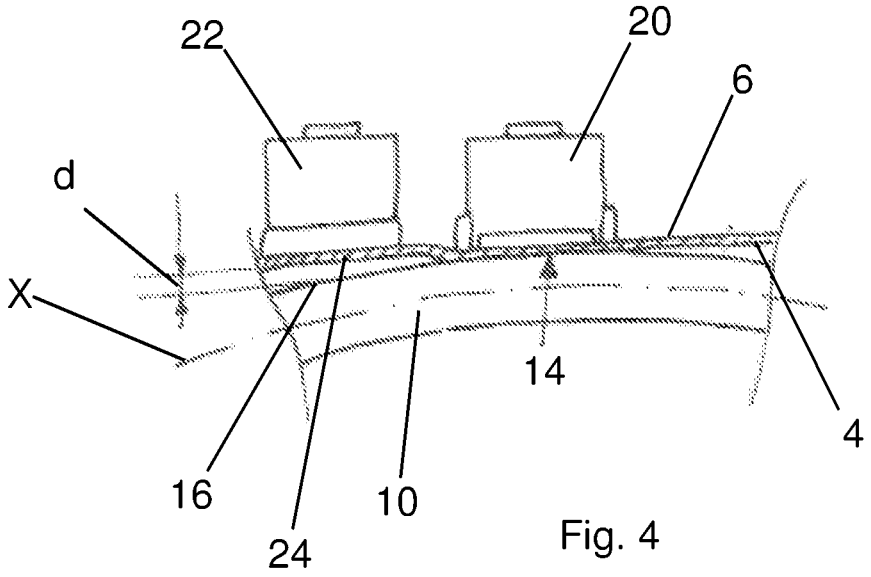
FIG. 4 shows a diagrammatic view of a detail of a variant of the cover of the invention.

According to one variant, of which only a detail useful for supporting the understanding thereof is illustrated in FIG. 4, the lower face 4 is provided with a recess 24 to which corresponds a raised portion of the upper face 6. In particular, recess 24 is adjacent to portion 14 of heating stretch 10 connected to the lower face 4. Thermostat 22 is in contact with face 6 at such a recess 24, i.e. it is arranged on the raised portion. Therefore, the lower face 4 is spaced apart from the heating stretch 10 at recess 24 by a predetermined distance d. One advantage of recess 24 is appreciated in the production step, because it allows the area of the lower face 4 where the welding or brazing is to be performed, to be easily and accurately identified. Preferably, the minimum distance "d" between portion 16 and the inner face 4 of the cover is equal to at least 0.5 mm or more. There is an empty space between portion 16 and the inner face 4.

Figure 1:
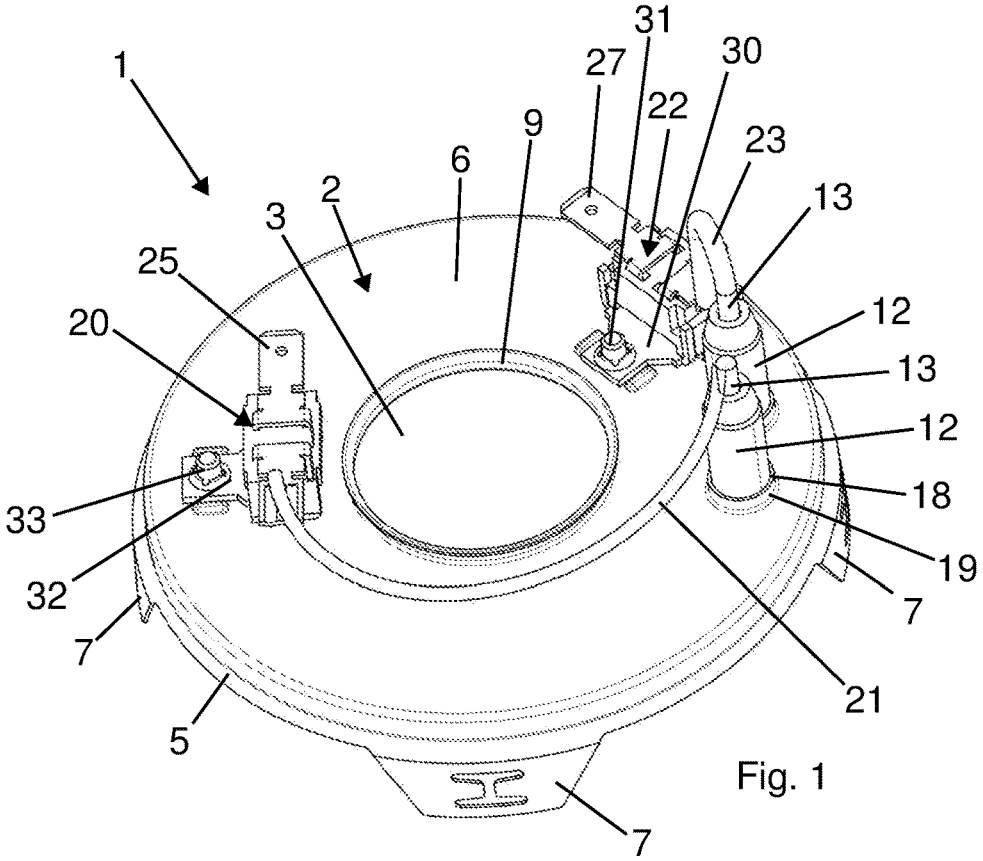
FIG. 1 shows an axonometric view from the top, of a cover for centrifugal pump according to the invention.
Figure 2:
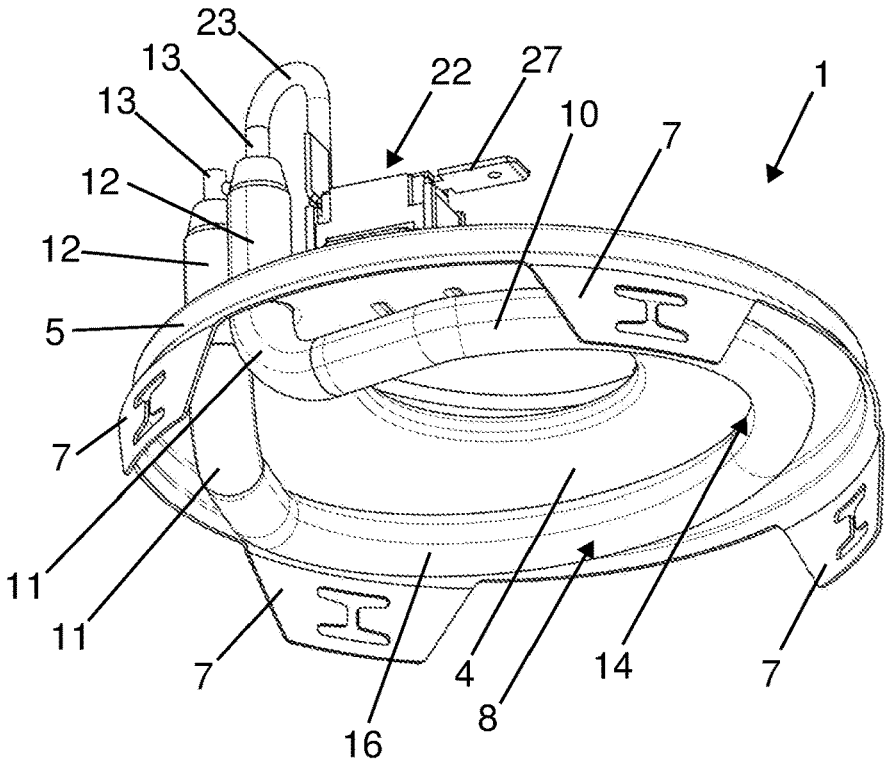
FIG. 2 shows an axonometric view from the bottom, of the cover in FIG. 1.
Figure 3:
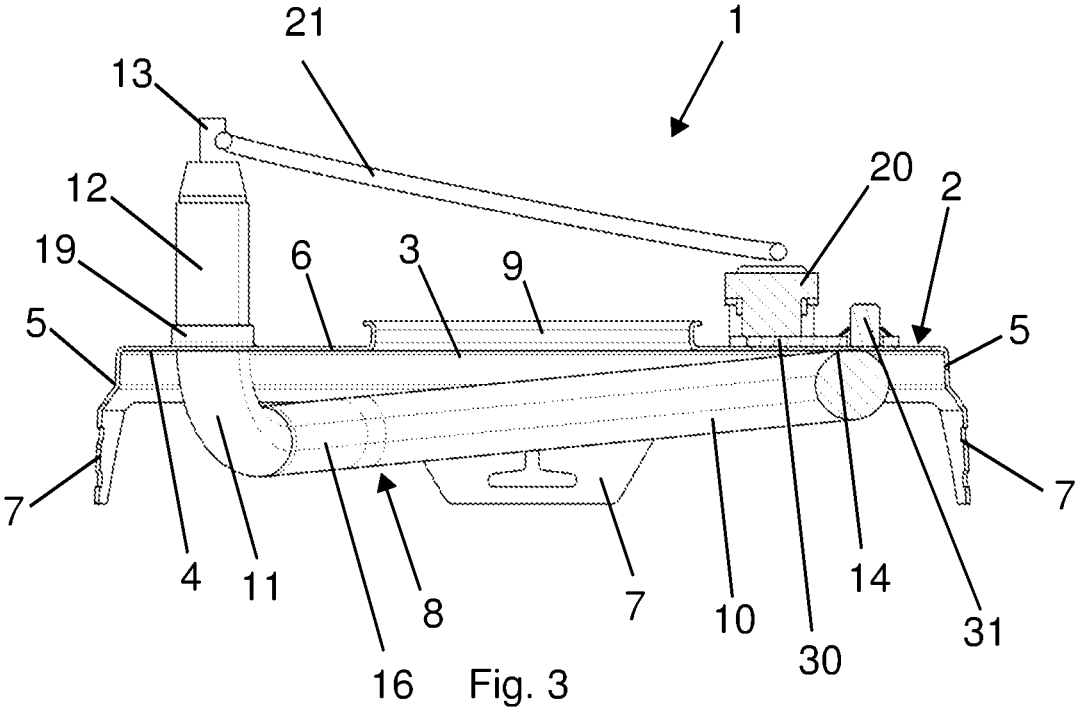
FIG. 3 shows a sectional view of the cover in FIG. 1.

In general, the thermal fuse 20 and thermostat 22 can be fixed to the upper face 6 in many ways. In particular, fixing pins can be used, for example threaded fixing pins, coupled to holes of the wall, or elastic, welding, brazing fixing means. Moreover, such as for example in the embodiment shown in FIGS. 1 to 3, an intermediate thermally conductive element, for example a metal plate, can also be provided below the thermal fuse and/or the thermostat. In particular, a plate 30 is provided below the thermal fuse 20. Plate 30 is in contact on one side with the upper face 6 and on the opposite side with the thermal fuse 20. Plate 30 is at least partly at portion 14. Preferably, plate 30 has a maximum extension of 25 mm along the upper face 6.

Similarly, and therefore not described in detail, thermostat 22 is assembled on a metal plate 32. Preferably, the fixing of the plates 30, 32 is obtained by means of a respective pin 31, 33.

Alternatively, the thermal fuse and/or the thermostat are directly fixed on the upper face. Also in this case, the thermal fuse may be at or close to portion 14, as described above.

Figure 6:
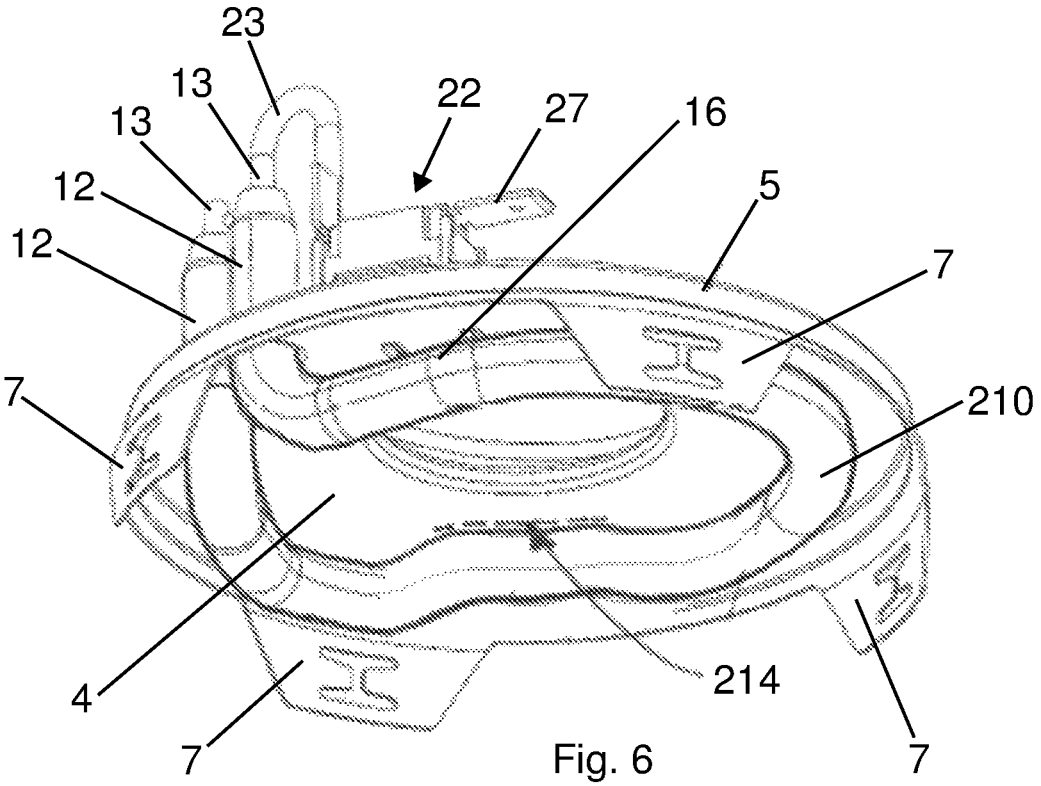
FIG. 6 shows another variant of the cover of the invention.

According to a further variant, shown in FIG. 6, portion 214 of the heating stretch 210 in contact with the lower face 4 is at about 90° with respect to the end stretches 12. In this case, portion 214 defines an axis which is offset with respect to the axis of the remaining portion of heating stretch 210. In general, it is preferable for the contact portion to be arranged while taking into consideration the final orientation of the pump with respect to the household appliance in which it is assembled. In particular, it is preferable for the contact portion to be at as high a height as possible with respect to the base of the household appliance.

By mere way of example, to make cover 1, the end stretches 12 of resistor 8 can be inserted into the holes 18 from the bottom upwards with reference to the illustrations in the drawings. Then a welding or brazing of the end stretches is performed at the inner edge of the respective hole and, when provided, at least one portion of the heating stretch is welded or brazed to the lower face 4.

After having provided an exemplary description of embodiments of the invention, certain clarifications are given to avoid the invention from being interpreted incorrectly or interpreted within a limiting sense. In particular, it is apparent that the terms upper, lower, downwards, upwards, outwards and the like are used solely for descriptive purposes, in conventional manner, and referring to the accompanying drawings.

The invention claimed is:

1. A cover for a centrifugal pump for a liquid of a household appliance, the cover comprising:

an inlet, a wall surrounding the inlet and delimiting a pumping chamber, the wall having an inner face destined to come into contact with the liquid and an outer face, opposite to the inner face, an electric resistor for heating the liquid, fixed to the cover and having a heating stretch, and two end stretches connected to the heating stretch, wherein the electric resistor crosses the cover so that the heating stretch extends from the inner face and the two end stretches project from the outer face, whereby the heating stretch is apt to be in contact with the liquid in the pumping chamber, wherein the heating stretch comprises at least one first portion in contact with the inner face and at least one second portion spaced apart from the inner face by an empty space between the at least one second portion and the inner face, said at least one first portion being welded or brazed to the inner face; and the centrifugal pump is configured to pressurize the liquid from the inlet such that it flows through the empty space in the pumping chamber.

2. The cover according to claim 1, wherein the heating stretch defines an axis X, and wherein the at least one first portion has a length along the axis X ranging between 1% and 50% of an overall length of the heating stretch along the axis X.

3. The cover according to claim 2, wherein there are provided two connection stretches, each connection stretch joins a respective end stretch with the heating stretch, and wherein said two connection stretches and said end stretches extend transversally to the axis X.

4. The cover according to claim 1, wherein the heating stretch defines an axis X, and wherein the at least one second portion has a length along the axis X which is greater than a length along the axis X of the at least one first portion.

5. The cover according to claim 4, wherein the at least one first portion has a length along the axis X ranging between 10% and 40% of an overall length of the heating stretch along the axis X.

6. The cover according to claim 4, wherein the at least one first portion has a length along the axis X ranging between 10% and 20% of an overall length of the heating stretch along the axis X.

7. The cover according to claim 4, wherein there are provided two connection stretches, each connection stretch joins a respective end stretch with the heating stretch, and wherein said two connection stretches and said end stretches extend transversally to the axis X.

8. The cover according to claim 1, wherein the wall is provided with two holes, each hole being delimited by a respective inner edge, and wherein the end stretches cross a respective hole and are fixed to the respective inner edge, so that the two holes are fluid-tight sealed.

9. The cover according to claim 8, wherein the end stretches are welded or brazed to the respective inner edge.

10. The cover according to claim 1, wherein the heating stretch defines a curvilinear axis X lying in a first plane A, and the end stretches define two respective axes J and K, the two axes lying on a second plane B.

11. The cover according to claim 9, wherein the first plane and the second plane are inclined to each other by an angle (a) which is less than 90°.

12. The cover according to claim 1, comprising at least one safety device fixed to the outer face, it being in contact with a first area of the outer face close to or at said at least one first portion of the heating stretch.

13. The cover according to claim 12, comprising at least one control device fixed to the outer face, it being in contact with a second area of the outer face which is different from the first area.

14. The cover according to claim 13, wherein the inner face is provided with a recess at said second area.

15. The cover according to claim 1, comprising at least one control device fixed to the outer face.

16. The cover according to claim 1, wherein a minimum distance by which the at least one second portion is spaced apart from the inner face is equal to at least 0.5 mm.

17. The cover according to claim 16, wherein a maximum distance between the at least one second portion and the inner face is between 20 mm and 40 mm.

18. A centrifugal pump for a liquid of a household appliance comprising:

a body and a cover comprising an inlet, a wall surrounding the inlet and delimiting a pumping chamber, the wall having an inner face destined to come into contact with the liquid and an outer face, opposite to the inner face, an electric resistor for heating the liquid, fixed to the cover and having a heating stretch, and two end stretches connected to the heating stretch, wherein the electric resistor crosses the cover so that the heating stretch extends from the inner face and the two end stretches project from the outer face, whereby the heating stretch is apt to be in contact with the liquid in the pumping chamber, wherein the heating stretch comprises at least one first portion in contact with the inner face and at least one second portion spaced apart from the inner face by an empty space between the at least one second portion and the inner face, said at least one first portion being welded or brazed to the inner face;

said cover being restrained to the body and the centrifugal pump is configured to pressurize the liquid from the inlet such that it flows through the empty space in the pumping chamber.

19. The centrifugal pump according to claim 18, wherein the heating stretch defines a curvilinear axis X, and wherein the at least one second portion has a length along the curvilinear axis X which is greater than a length along the curvilinear axis X of the at least one first portion.

* * * * *